US005948302A

United States Patent [19]

Horvath

[11] Patent Number: 5,948,302

[45] Date of Patent: Sep. 7, 1999

[54] ACRYLIC WARMER FOR MANICURING PURPOSES

[75] Inventor: Gabriel Horvath, Tarzana, Calif.

[73] Assignee: OPI Products Inc., North Hollywood, Calif.

[21] Appl. No.: 08/986,350

[22] Filed: Dec. 8, 1997

[51] Int. Cl.[6] ..... F27D 11/00

[52] U.S. Cl. ..... 219/433; 219/436; 219/385; 219/386

[58] Field of Search ..... 219/433, 436, 219/438, 385, 386, 421; 264/404

[56] References Cited

U.S. PATENT DOCUMENTS 4,463,664 8/1984 Peace ..... 99/323.3

*Primary Examiner*—Teresa Walberg
*Assistant Examiner*—Shawntina T. Fuqua
*Attorney, Agent, or Firm*—Leonard Tachner

[57] ABSTRACT

An assembly for warming and containing warmed acrylic liquid for manicuring application. The electric warmer is especially designed to efficiently heat a geometrically-matched dappen dish containing acrylic liquid to bring the temperature of the liquid sufficiently high to prevent crystallization before application to the fingernails. The heater and dappen dish assembly is uniquely designed to provide unobstructed access to the warmed liquid while the dish remains in the heater. The heater provides a dish enclosure which has a chamber that is congruent with the exterior of the dappen dish to provide efficient heat transfer and to minimize the size of the warming assembly for a given quantity of liquid.

2 Claims, 2 Drawing Sheets

ACRYLIC WARMER FOR MANICURING PURPOSES

BACKGROUND OF THE INVENTION

1. Field of the Invention

The present invention relates generally to the field of manicuring materials and more specifically to a manicuring liquid warming assembly wherein acrylic liquid in a dappen dish is kept at an elevated temperature to prevent inadvertent crystallization of the acrylic.

2. Prior Art

A search of the prior art has revealed the following pertinent issued U.S. Patents:

| | |
|---|---|
| 1,043,561 | Ayer |
| 2,409,668 | Dailey |
| 3,083,286 | Swetlitz |
| 3,485,353 | Reiter |
| 3,681,568 | Schaefer |
| 3,828,848 | Custers et al |
| 3,875,370 | Williams |
| 4,001,944 | Williams |
| 4,092,138 | Beitner |
| 4,107,513 | Ashford |
| 4,253,013 | Mabuchi |
| 4,555,616 | O'brien |
| 5,248,870 | Redal |

Of the above-listed patents, the following appear to be the most relevant:

U.S. Pat. No. 2,409,668 to Dailey is directed to a heat transfer means in which a dome shaped anode 11 is to be heated uniformly in a cavity 22 that is found within the heat transfer means 17. Flame 27 is applied to heat transfer means 17 which conducts the energy to the cavity 22 which is shaped to conform to the dome shape of the anode 11. Thus, a uniform heat transfer to the entire anode area is made possible by the heat transfer means 17. Heat transfer means 17 comprises a metallic core 18 which provides for the transfer of heat between the flame 27 and the anode 11 residing in the cavity 22 of the heat transfer means 17.

U.S. Pat. No. 1,043,561 to Ayer is directed to a test tube heater wherein a rack or slab 10, made of any suitable conductive metal, is shaped with holding pockets 13 formed to fit the bottom portion of test tubes "a" in order to provide efficient heat transfer between heater elements 15 to the test tubes "a" in holding pockets 13. Thus, the invention provides for heat to be uniformly and evenly applied throughout the length of the test tubes and over a large area thereof.

U.S. Pat. No. 4,001,944 to Williams is directed to a freeze-drying process wherein a cast aluminum or magnesium tray is used for efficient heat transfer. Referring to the figures, the tray or block 10 includes a plurality of cavities 12 adapted to receive cylindrical bottles or containers 14 in a close fit. Thus, the heat is transferred quickly and uniformly from the contents of the bottles by means of the cast metal tray device.

U.S. Pat. No. 4,253,013 to Mabuchi is directed to an electric heating device which includes a heat transfer portion which closely fits the shaver head to be warmed. Referring to the figures, the warmer comprises a heat transfer portion 2 which is made of aluminum and has one or more heating cylinders that closely fit the shaving heads of electric shavers 28. A recess 6 is provided on the bottom surface of the heating cylinder 3 so as to ensure good contact with the outer surface of the shaving head to be heated. The heat transfer portion 2 is fixed to an aluminum heat transfer plate 12 below the heating cylinder 3. Heating element 14 is positioned between the aluminum base plate 15 and the heat transfer plate 12. The device is intended to maintain the shaver heads, held within the cup-shaped members, to a temperature within a predetermined temperature range.

U.S. Pat. No. 4,092,138 to Beitner is directed to a dental desk unit which includes a hot section for maintaining instruments or materials at a desired temperature. Referring to the Figures, the hot section 10 comprises a hot plate 14 and a well section 16 containing a plurality of vial-holding wells 18. The hot section is made of a unitary block of heat-conducting material, preferably aluminum. The block has a flat upper surface 14–16 and a flat lower surface 22 as well as front, side and back walls 52, 54, 56 and 58 which along with fins 60 help to dissipate the heat from the hot section 10 and thus to regulate the temperature thereof. The object of the invention is to maintain a temperature in the hot section so that vials containing material when placed within wells 18 will be maintained at some predetermined desired temperature.

U.S. Pat. No. 3,083,286 to Swetlitz is directed to a pliant surface heating unit that conforms to the surface contour of an object being heated. Referring to the Figures, the surface heating unit 10 is a hot-plate type heater which generates heat for transmission to the surface 12. Objects to be heated may be placed directly on the upper exposed surface and heated or controlled by a suitable thermostat and heater means. The upper surface of heat transfer plate 22 is covered with a mass or layer 26 of a low melting point material which has good heat conducting properties but becomes molten at some particular temperature in order to conform to the shape of the vessel being heated.

While the aforementioned prior art patents disclose devices for heating liquids in containers, there is no apparent prior art patent which discloses a heating assembly suitable for use with a dappen dish for efficiently heating an acrylic liquid and providing easy access to the warmed acrylic for manicuring application.

SUMMARY OF THE INVENTION

The present invention provides an assembly for warming and containing warmed acrylic liquid for manicuring application. The electric warmer is especially designed to efficiently heat a geometrically-matched dappen dish containing acrylic liquid to bring the temperature of the liquid sufficiently high to prevent crystallization before application to the fingernails. The heater and dappen dish assembly is uniquely designed to provide unobstructed access to the warmed liquid while the dish remains in the heater. The heater provides a dish enclosure which has a chamber that is congruent with the exterior of the dappen dish to provide efficient heat transfer and to minimize the size of the warming assembly for a given quantity of liquid.

OBJECTS OF THE INVENTION

It is therefore a principal object of the present invention to provide an assembly for warming acrylic liquid.

It is another object of the invention to provide a high efficiency heating assembly including a dappen dish for holding warmed acrylic liquid for manicuring applications.

It is still another object of the invention to provide a combination of a geometrically matched heater assembly and dappen dish to efficiently warm acrylic liquid and provide access to the warmed liquid without having to remove the dappen dish from the heater assembly.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF PREFERRED EMBODIMENT

Figure 1:
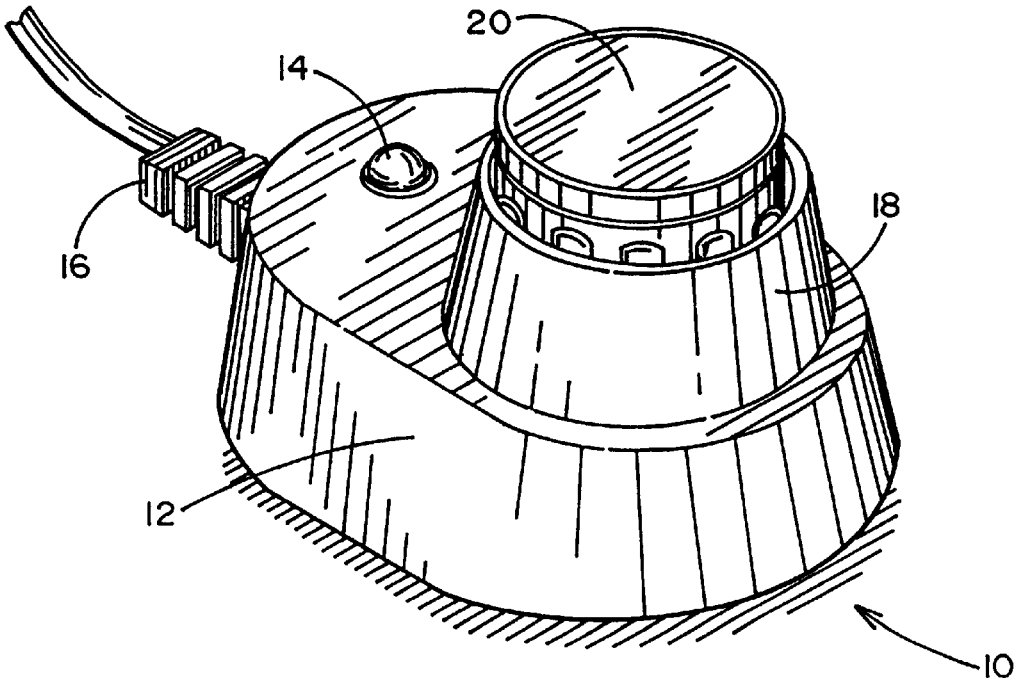
FIG. 1 is a perspective view of the preferred embodiment of the manicuring liquid warming assembly of the invention.
Figure 2:
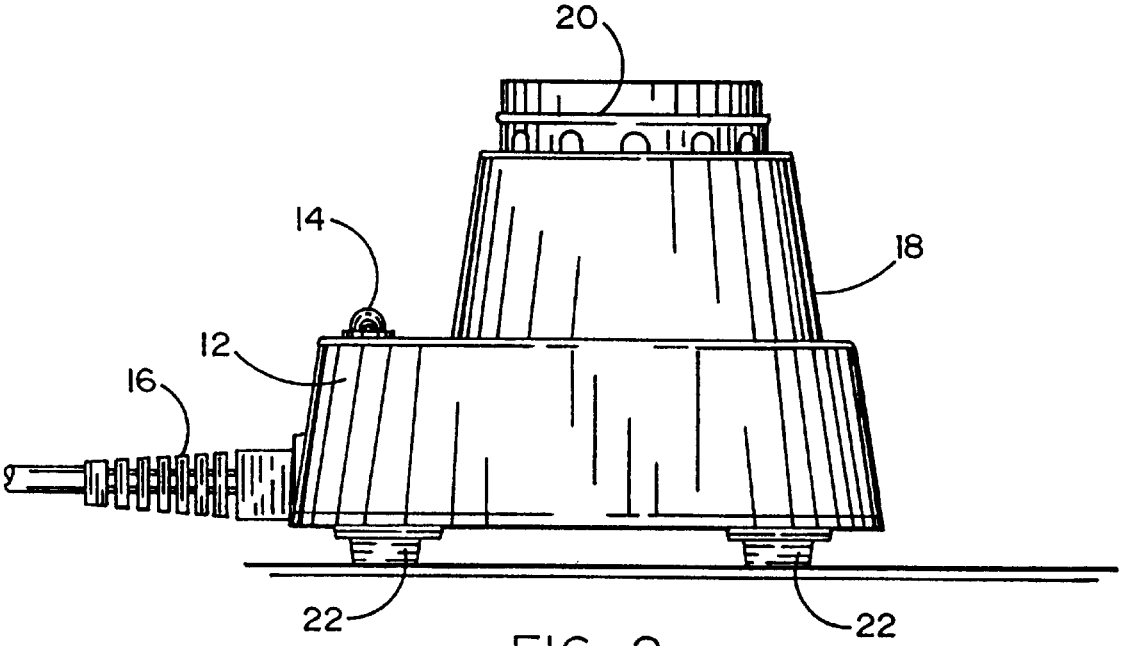
FIG. 2 is an elevational view thereof.

Referring to the accompanying figures, it will be seen that the manicuring liquid warming assembly 10 comprises a heater 12, a dish enclosure 18 and a dappen dish 20. The heater 12 provides an AC power cord 16 bringing electrical power to a heating element 15 (see FIG. 4) the latter being structurally supported within the heater 12 by a post 17 and being electrically connected by electrodes 28 to the power cord 16. An indicator 14 displays a "heat-on" condition. A plurality of feet 22, provide an isolated support for the assembly 10.

Figure 3:
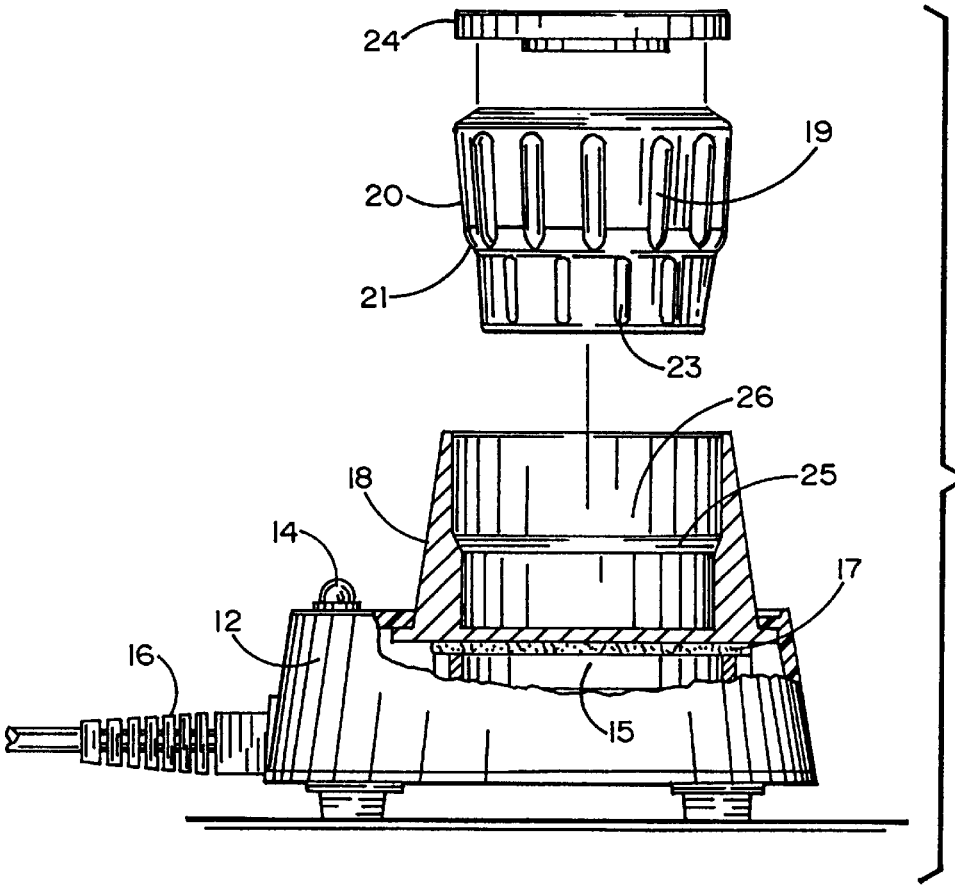
FIG. 3 is a partially sectioned, exploded view thereof.
Figure 4:
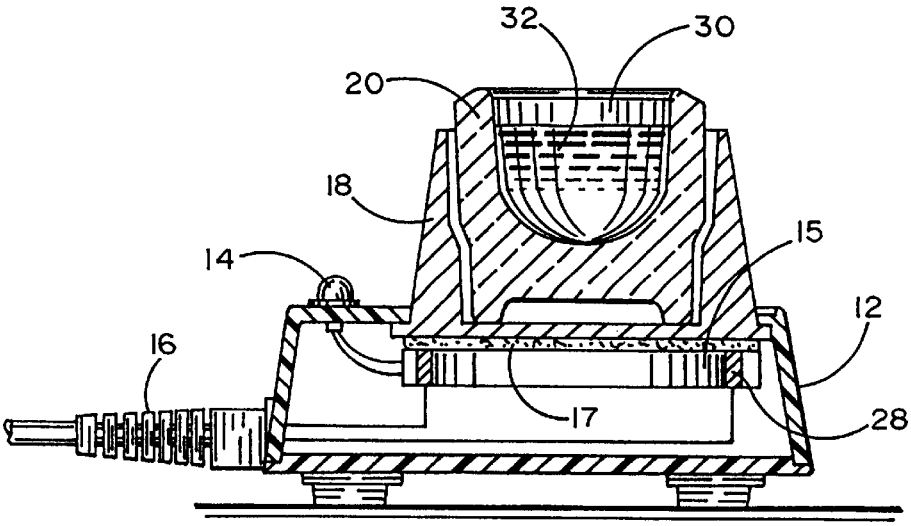
FIG. 4 is a cross-sectional view of the preferred embodiment.

As seen best in FIGS. 3 and 4, the enclosure 18 provides a dish chamber 26 which is substantially congruent with the exterior of dappen dish 20. Thus for example, an enclosure shoulder 25 is located to engage a dish shoulder 21, thereby assuring efficient heat transfer from the heated enclosure to the dish. To make it easier to position and remove the dish 20 from chamber 26 of enclosure 18, the exterior of the dappen dish is provided with a plurality of ridges, namely upper ridges 19 and lower ridges 23.

It will also be seen that a dish cover 24 is provided to promote efficient heating of the acrylic liquid and to provide easy access to the warmed liquid 32 which is located in the cup 30 of the dappen dish 20. Although not shown herein, it will be understood that the liquid warming assembly 10 preferably provides a preset thermostat and relay or solid state switch for maintaining the liquid at a temperature of about 95 degrees Fahrenheit, but at least higher than 74 degrees Fahrenheit. A thermostat and relay or switch circuit to maintain a narrow range of temperature variation is well known in the art of electric heaters and need not be disclosed herein. The novelty of the invention relates to the heating of a manicuring liquid in a dappen dish in a manner which permits efficient warming of the liquid and ready access thereto.

Having thus disclosed a preferred embodiment of the invention, it being understood that the disclosed embodiment is merely exemplary and not necessarily limiting, what is claimed is:

1. A method for preventing crystallization of acrylic liquid used in manicuring; the method comprising the following steps:

a) providing a dappen dish and at least partially filling said dappen dish with an acrylic designed for manicuring applications, said dappen dish having an exterior surface;

b) placing said dappen dish in a heater having an enclosure, the enclosure having a receiving surface which is substantially congruent to the exterior surface of said dappen dish;

c) covering said dappen dish to reduce heat loss from said acrylic;

d) heating said dappen dish and said acrylic until the temperature of said acrylic is sufficiently high to prevent crystallization of said acrylic; and e) uncovering said dappen dish to provide access to said heated acrylic.

2. The method recited in claim 1 wherein step a) further comprises the step of providing a plurality of ridges on said surface exterior of said dappen dish to facilitate selective removal of said dappen dish from said heater enclosure.

* * * * *